United States Patent [19]

Carlson

[11] 4,072,450

[45] Feb. 7, 1978

[54] PUMP ASSEMBLY

[75] Inventor: Robert E. Carlson, Livonia, Mich.

[73] Assignee: TRW Inc., Cleveland, Ohio

[21] Appl. No.: 648,474

[22] Filed: Jan. 12, 1976

[51] Int. Cl.[2] ..... F04C 15/00

[52] U.S. Cl. ..... 418/133

[58] Field of Search ..... 418/131, 132, 133, 134, 418/135; 417/310

[56] References Cited

U.S. PATENT DOCUMENTS

| | | | |
|---|---|---|---|
| 3,171,359 | 3/1965 | Spencer et al. | 418/131 X |
| 3,200,752 | 8/1965 | Clark et al. | 418/135 X |
| 3,499,390 | 3/1970 | Prijatel | 418/132 |
| 3,822,965 | 7/1974 | Drutchas | 418/135 X |

*Primary Examiner*—William L. Freeh
*Assistant Examiner*—Leonard E. Smith

[57] ABSTRACT

An improved pump assembly includes a pressure plate having inlet and outlet ports for conducting fluid to and from a pumping chamber. The pressure plate includes three layers formed by plate sections having major side surfaces which are bonded together to prevent leakage between the layers. A first one of the plate sections has an outer side surface which is disposed adjacent to the pump rotor. This first plate section is advantageously made of a wear-resistant material to minimize wear upon rotation of the rotor. An intermediate plate section is disposed between the first plate section and a second plate section. The intermediate plate section cooperates with at least one of the two outer plate sections to form a passage which interconnects a pair of ports formed in the pressure plate. In the illustrated embodiment of the invention, the passage is utilized to connect a pair of inlet ports in fluid communication.

14 Claims, 5 Drawing Figures

PUMP ASSEMBLY

BACKGROUND OF THE INVENTION

The present invention relates to a pump assembly and, more specifically, to a pump assembly having a new and an improved multilayer pressure plate.

A known slipper-type pump is disclosed in U.S. Pat. No. 3,200,752. This known slipper type pump has a pressure plate which is disposed in abutting engagement with the outer ring and adjacent to the rotor of a pumping element cartridge. A pair of inlet ports in the pressure plate are connected in fluid communication with each other along a path which includes a passage formed in a valve plate. Similarly, a pair of outlet ports in the pressure plate are connected in fluid communication with each other along a path which includes another passage formed in the valve plate. The forming of the various plate passages contributes substantially to the cost of making this known pump.

Another known pump is disclosed in U.S. Pat. No. 3,671,143. This pump includes a pressure plate which is made up of two plate members formed of powdered metal. The plate members are sintered or fused together to form a firm bond between the two plates. Passages are provided in the two plates to conduct fluid between a pair of outlet ports.

SUMMARY OF THE PRESENT INVENTION

The present invention provides a pump having a new and an improved pressure plate assembly. This pressure plate assembly is advantageously formed by connecting a plurality of plate sections together. These plate sections are constructed so as to provide inlet ports through which fluid at a relatively low pressure enters a pumping chamber having two separate working areas formed by cooperation between a ring member and rotor. In addition, the pressure plate assembly is provided with a pair of outlet ports which conduct relatively high pressure fluid from the pumping chamber.

The pressure plate assembly includes a first or outer plate section which is disposed in abutting engagement with the ring member and adjacent to the rotor. A second outer plate section is disposed in engagement with a valve plate. An intermediate plate section is disposed between the two outer plate sections and cooperates with them to define an interior passage interconnecting the inlet ports. By interconnecting the two inlet ports in this manner, it is assured that an adequate supply of fluid will be supplied to both inlet ports at substantially the same pressure. It is contemplated that the passage could be utilized to interconnect the outlet ports if desired.

The outer plate section which engages the rotor is advantageously formed of a wear-resistant metal. This promotes a relatively long pump life, since the outer plate section when engaged by the rotor tends to wear during operation of the pump. By forming the other outer plate sections of a relatively tough and yieldable metal, the rotor pressure plate section is reinforced to prevent breaking during operation of the pump assembly.

Accordingly, it is an object of this invention to provide a new and improved pump having a pressure plate assembly which is formed with a plurality of plate sections which are connected together and wherein an intermediate plate section cooperates with a pair of outer plate sections to define an interior passage interconnecting a pair of ports.

Another object of this invention is to provide a new and improved pump having a pressure plate assembly formed of a plurality of interconnected plate sections and wherein one of the plate sections is disposed adjacent to the rotor of the pump and is formed of a wear-resistant material or surface.

Brief Description of the Drawings

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
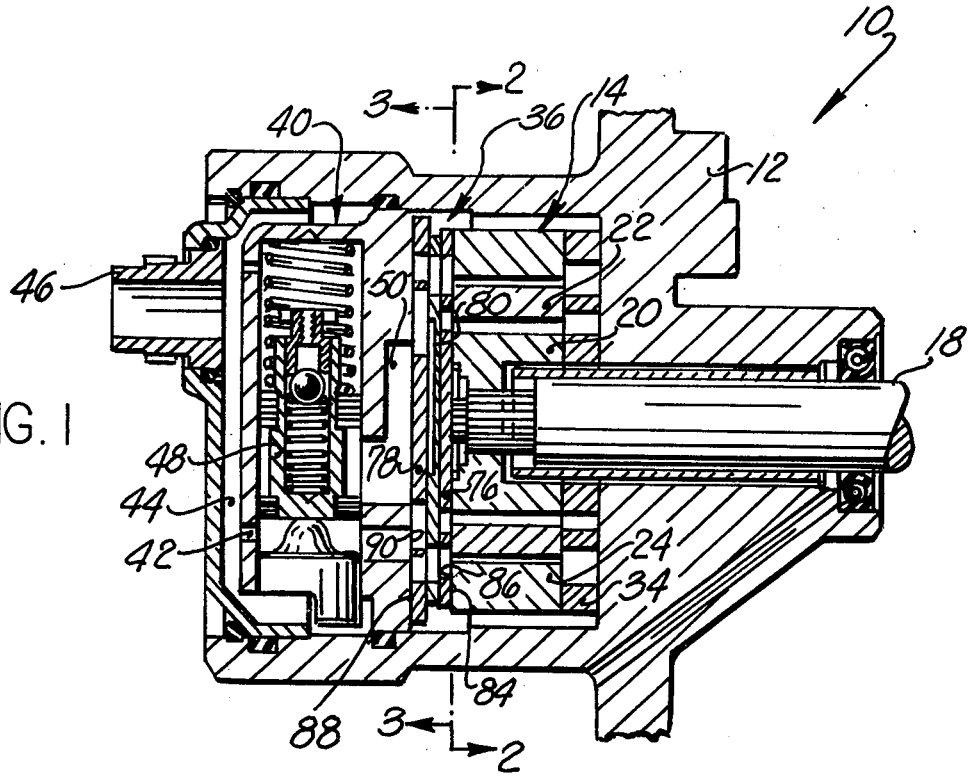
FIG. 1 is a sectional view of a pump having a pressure plate assembly constructed in accordance with the present invention.
Figure 2:
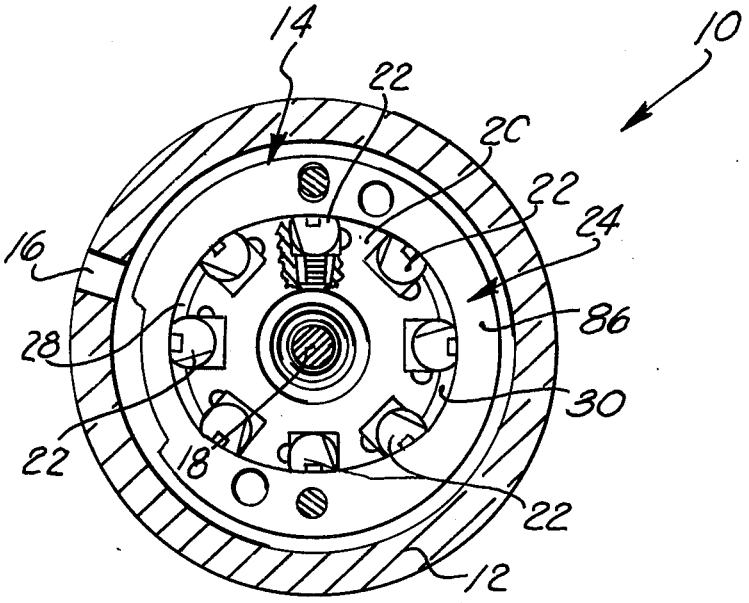
FIG. 2 is a sectional view, taken generally along the line 2—2 of FIG. 1, illustrating the construction of a pumping cartridge.

A power steering pump assembly 10 having a housing 12 which is partially enclosed by a reservoir container (not shown) is illustrated in FIG. 1. The pump assembly 10 includes a pumping element cartridge 14 (FIG. 2) which is supplied with fluid from the reservoir through an inlet passage 16 in the housing 12. Upon rotation of an input shaft 18, a rotor 20 in which slippers 22 are mounted is rotated relative to a stationary ring 24 which is shaped to provide a pair of working areas or chambers 28 and 30.

As the rotor is rotated relative to the ring 24, low pressure fluid from the reservoir is directed into the working areas 28 and 30 through a lower pressure plate 34 and an improved upper pressure plate assembly 36 (FIG. 1). The pressure plates 34 and 36 are also effective to port high pressure fluid from the working chambers 28 and 30 via outlet ports 68 and 72 to a valve plate 40 having a flow control orifice 42 (FIG. 1) through which fluid is directed to a pressure chamber 44 and an outlet 46. A bypass valve 48 is mounted in the valve plate 40 and is operable to vent excessive fluid flows to a bypass passage 50. The manner in which the pumping element cartridge 14, upper and lower pressure plates 34 and 36, valve plate 40 and bypass valve 48 cooperate is well known and is the same as described in U.S. Pat. No. 3,200,752 to Clark et al. and will not be further described herein to avoid prolixity of description.

In accordance with a feature of the present invention, the upper pressure plate assembly 36 has a plurality of layers formed by plate sections having major side surfaces which are bonded together to prevent leakage of fluid between the plate sections. By utilizing a plurality of plate sections which are bonded together, machining operations to form inlet and outlet ports in the plate assembly 36 are simplified. This is because the ports can be formed by separately machining each of the plates before they are interconnected with a resulting elimination of secondary machining operations which are rather difficult and expensive to perform. In addition by forming the pressure plate assembly 36 of a plurality of plate sections, different metals can be used to provide both wear resistance and strength as required.

The pressure plate assembly 36 includes a pair of main inlet ports 56 and 58 (see FIG. 3) which direct fluid at a relatively low pressure to two working areas 28 and 30 of the pumping element cartridge 14. A pair of minor inlet ports 60 and 62 are provided in association with the main inlet ports 56 and 58 to provide for fluid flow radially inwardly of the slippers 22. A pair of major outlet ports 66 and 68 cooperate with the working areas 28 and 30 to port relatively high pressure fluid from the working areas to the valve plate 40. A pair of minor outlet ports 70 and 72 are provided in association with the major outlet ports 66 and 68 to vent fluid from beneath the slippers 22.

The pressure plate assembly 36 is of a three-layered construction, with each of the layers being formed by a plate section. Thus, a first outer layer is formed by a plate section 76 (FIG. 4), a second outer layer is formed by a plate section 78 and an intermediate layer is formed by a plate section 80. The first plate section 76 has a major side surface 84 which is disposed in flat abutting engagement with an end surface 86 of the pumping element cartridge ring 24 (see FIGS. 1 and 2). A major side surface 88 (FIG. 4) of the second outer plate section 78 is disposed in flat abutting engagement with a surface 90 of the valve plate 40 (see FIG. 1). The intermediate plate section 80 has a pair of major side surfaces 94 and 96 (FIG. 4) which are disposed in flat abutting engagement with inner major side surfaces 98 and 100 of the two outer plate sections 76 and 78. To prevent fluid leakage, the major side surfaces 94 and 96 of the intermediate plate section 80 are intimately bonded to the major side surfaces 98 and 100 of the outer plate sections 76 and 78 by a brazing operation. However, it is contemplated that the major side surfaces of the intermediate plate section 80 could be intimately bonded to the major side surfaces of the outer plate sections 76 and 78 by other means, such as by utilizing an epoxy cement or by fusing operation.

By forming the pressure plate assembly 36 of a plurality of plate sections, the various ports in the pressure plate assembly can be formed by merely performing relatively simple stamping or machining operations on each plate section before the plate sections are bonded together. Thus, the inlet port 58 is formed by cutting away the outer plate section 76 to provide the outer plate section with a minor side surface 104 having the configuration illustrated in FIG. 3. The minor side surface 104 includes a pair of inwardly extending side sections 106 and 108 which are interconnected by an arcuately curving bottom section 110. It should be noted that the minor side surface 104 can be formed to the desired configuration with relatively simple machining operations. The small inlet port 62 is formed by a minor surface 112 which extends perpendicular to the major side surfaces 84 and 98 of the outer plate section 76 and therefore can be readily formed in the outer plate section before it is bonded to the intermediate plate section 80. The outer plate section 76 is cut away to form the opposite inlet ports 56 and 60 in the same manner as in connection with the inlet ports 58 and 62.

The outlet port 66 is defined by a minor side surface 116 which extends perpendicular to the two major side surfaces 84 and 98 of the outer plate section 76. Similarly, the small outlet port 70 is defined by a minor side surface 118 which extends perpendicular to the two major side surfaces 84 and 98 of the outer plate section 76. Since the minor side surfaces 116 and 118 forming the outlet ports 66 and 70 extend perpendicular to the major sides of the plate section 76, they can be formed with relatively simple machining operations before the various plate sections are bonded together.

The intermediate plate section 80 is machined prior to being bonded with the two outer plate sections 76 and 78 to further define the inlet and outlet ports. Thus, the intermediate plate section 80 has a minor side surface 122 (FIG. 4) which extends perpendicular to the two major side surfaces 94 and 96 of the intermediate plate section 80 and is cut away so as to extend inwardly to the inlet port 62. The second outer plate section 78 is not cut away in the area of the inlet port 58. Therefore, fluid can flow radially inwardly in the manner indicated by the arrows 126 in FIG. 4 along the major side surface 100 and outer plate section 78 to both the major inlet port area 58 and the minor inlet port area 62. It should be noted that if the pressure plate assembly 36 was formed as an integral part from a single piece of metal, relatively complicated machining operations would have to be performed in order to provide the major and minor inlet ports 58 and 62 with a configuration similar to that illustrated in FIGS. 3 and 4. The inlet ports 56 and 60 have the same configuration and are formed in the same way as the inlet ports 58 and 62.

The plate sections 78 and 80 are provided with outlet openings 130 and 132 (FIG. 4) to form a part of the fluid outlets 66 and 70 through which fluid flows from the working areas 28 and 30 of the pumping element cartridge. It should be noted that the opening 130 in the intermediate plate section 80 is formed by a minor side surface which extends perpendicular to the two major side surfaces 94 and 96 of the intermediate plate section 80. The opening 130 is sufficiently large so as to include the areas of both the major outlet port 66 and the minor outlet port 70 within the area of the opening 130 (see FIG. 4). The opening 132 in the outer plate section 78 is slightly larger than the opening 130 in the intermediate plate section 80 to promote a flow of fluid through the pressure plate assembly 36 to the valve plate 40 with a minimum of resistance. Although the construction of only the outlet ports 66 and 70 are illustrated in FIG. 4, it should be understood that the outlet ports 68 and 72 have the same configuration as the outlet ports 66 and 70 and are formed in the same manner.

Since the pressure plate assembly 36 is formed of a plurality of plate sections which are joined together, an interior passage 140 between sections 76 and 78 interconnects the two inlet ports 56 and 58 can be easily formed in the intermediate plate section 80 before the sections are joined together. To form the passage 140, the intermediate plate section 80 is recessed to define a pair of side walls 144 and 146 (see FIGS. 3 and 5) which extend generally perpendicular to the major side surface 94 of the intermediate plate section 80.

Figure 4:
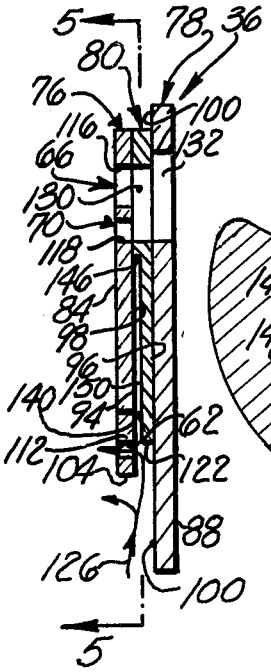
FIG. 4 is a sectional view, taken generally along line 4—4 of FIG. 3, illustrating the relationship between the plate sections.

The side walls 144 and 146 have a depth which is less than the thickness of the intermediate plate section 80 (see FIG. 4). When the plate sections are joined together, the passage 140 is defined by the side walls 144 and 146, the major side surface 98 of the outer plate section 76, and a relatively large flat surface 150 (see FIG. 5) disposed inwardly from and parallel to the major side surface 94 of the intermediate plate section 80. By forming the passage 140 in this manner, relatively difficult secondary machining operations are eliminated. In fact, without constructing the pressure plate assembly 36 with a layered construction, it would almost be impossible to form a relatively large interior passage, such as the passage 140, extending diammetrically across the pressure plate assembly between the two inlet ports 56 and 58 to maintain the pressure at the inlet ports substantially equal during operation of the pump assembly 10.

By locating the passage 140 in the intermediate plate section 80, the thickness of the two outer plate sections 76 and 78 is not reduced. This is particularly advantageous since a proportionately large reduction in the strength of a layered assembly occurs when the strength of either of the outer plates is reduced than when the strength of the intermediate plate is reduced by a similar amount. It is desirable to maximize the strength of the pressure plate assembly 36 to minimize the buckling or distortion that occurs when the pressure plate assembly is subjected to operating loads. If the pressure plate assembly was excessively distorted under operating pressure loads, it could engage the rotor 20 and cause a seizure of the pump. Another advantage which results from locating the passage or recess 140 in the plate 80 is that construction of the plate is facilitated. It is generally convenient, during stamping operations, to form slots or cut-outs in the intermediate plate 80. These cut-outs receive metal which is displaced during subsequent stamping and/or coining operations performed to form the recess 140 and/or improve the flatness of the part. Such cut-outs can be located in the intermediate plate 80 at locations where they will not effect the function of the pressure plate assembly 36. However, if these cut-outs or slots were located in an outer plate 76 or 78, they would effect the functional capability of the plate assembly.

Although it is preferred to form the passage 140 extending between the two inlet ports 56 and 58 by cutting away the intermediate plate section 80 to a depth less than the total thickness of the plate section, the plate section 80 could be formed in two parts with the passage 140 between these two parts. However, it is believed that this would complicate fabricating the plate assembly 36 since the two parts of the intermediate plate section 80 would have to be accurately positioned relative to each other and the two outer plate sections 76 and 78.

The major side surface 84 of the outer plate section 76 is disposed adjacent to the rotor 20 so that during operation of the pump assembly 10, the rotor tends to wear the outer plate section 76. In order to promote a relatively long pump life, the outer plate section 76 is formed of a wear-resistant metal. This wear-resistance can be obtained in many different ways, including forming the plate section 76 of a very hard metal, chemically treating the surface of the plate section, or by grit blasting and phosphate coating.

The very characteristics which make the metal of the outer plate section 76 wear-resistant also tend to make it weak when subjected to bending stresses. Therefore, the intermediate plate section 80 and second outer plate section 78 are formed of a relatively strong ductile metal which, although not having particularly good wear characteristics, does not have good bending strength characteristics. The bimetallic construction of the pressure plate assembly 36 is believed to provide the pressure plate assembly 36 with optimum operating characteristics. However, it should be understood that if desired, the outer plate section 76 could be formed of the same material as the plate sections 78 and 80 even though this could be detrimental to the wear-resistant characteristics of the plate assembly.

Figure 3:
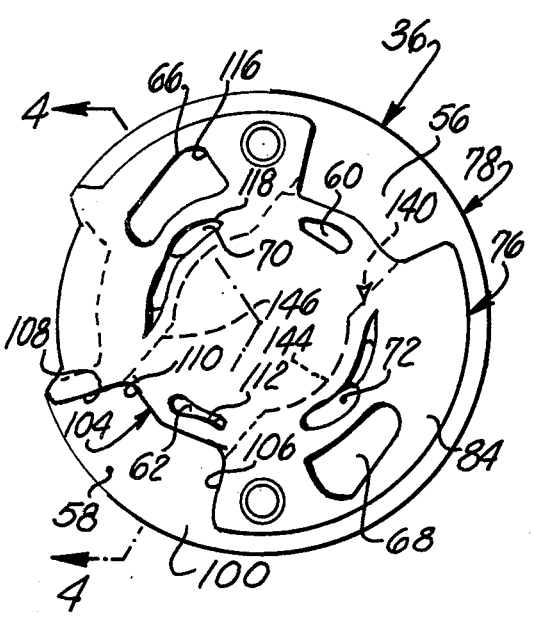
FIG. 3 is a plan view, taken generally along the line 3—3 of FIG. 1, illustrating a pressure plate assembly constructed in accordance with the present invention and made up of a plurality of plate sections which are bonded together.
Figure 5:
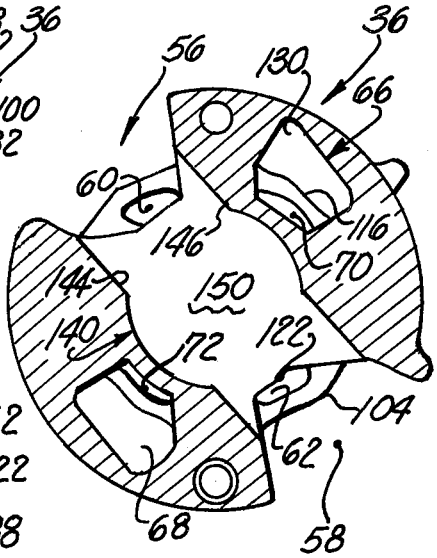
FIG. 5 is a sectional view, taken generally along line 5—5 of FIG. 4, illustrating a passage formed between the plate sections to interconnect a pair of inlet ports.

In the embodiment of the invention illustrated in FIGS. 3 through 5, the inlet ports 56 and 58 are interconnected by an interior passage 140 formed between the plate sections. However, it is contemplated that the pressure plate assembly could be constructed to provide an interior passage interconnecting the outlet ports.

In view of the foregoing description, it can be seen that the improved pressure plate assembly 36 is formed by bonding together a plurality of plate sections 76, 78 and 80. These plate sections are constructed so as to provide inlet ports 56 and 58 through which fluid at a relatively low pressure enters a pumping chamber having two separate working areas 28 and 30 formed by cooperating between a ring member 24 and a rotor 20. In addition, the pressure plate assembly 36 is provided with a pair of outlet ports 66 and 68 which conduct relatively high pressure fluid from the pumping chamber to a valve plate 40.

The pressure plate assembly 36 includes a first or outer plate section 76 which is disposed adjacent to the rotor 20 and in abutting engagement with ring 24. A second outer plate section 78 is disposed in abutting engagement with the valve plate 40. An intermediate plate section 80 is disposed between the two outer plate sections 76 and 78 and cooperates with them to define a passage 140 interconnecting the inlet ports 56 and 58. By interconnecting the two inlet ports 56 and 58 in this manner, it is assured that adequate supply of fluid will be supplied to both inlet ports at substantially the same pressure. The various plate sections are tightly joined together to prevent fluid leakage between the plate sections.

The outer plate section 76 which is adjacent to the rotor 20 is advantageously formed of a wear-resistant metal. This promotes a relatively long pump life, sine the outer plate section when engaged by the rotor tends to wear during operation of the pump assembly. By forming the other plate sections 78 and 80 of a relatively strong metal, the rotor pressure plate section 76 is reinforced to reduce bending and to prevent cracking during operation of the pump assembly.

Having described specific preferred embodiments of the invention, the following is claimed:

1. A pump assembly comprising a body member having a bore which at least partially defines a pumping chamber, a rotatable rotor disposed in said pumping chamber, said rotor cooperating with said bore to form two separate working areas, and pressure plate means for at least partially defining a pair of inlet ports through which fluid flows into said working areas during rotation of said rotor in said pumping chamber and a pair of outlet ports through which fluid flows from said working areas during rotation of said rotor in said pumping chamber, said pressure plate means including a plurality of plate sections having major and minor side surfaces and which cooperate to at least partially define said pairs of inlet and outlet ports, said plurality of plate sections includes a first plate section having an outer major side surface disposed in abutting engagement with said body member and said rotor, said first plate section being formed of a metal having a relatively high resistance to wear, a second plate section having a major side surface disposed in abutting engagement with a major side surface of said first plate section, and said second plate section being formed of a metal having a greater ductility and lower resistance to wear than the metal of said first plate section, and joining means for fixedly bonding a first major side surface of said second plate section to an inner major side surfaces of said first plate section to prevent leakage of fluid between said first major side surface of said second plate section and said inner major side surface of said first plate section.

2. A pump assembly comprising a body member having a bore which at least partially defines a pumping chamber, a rotatable rotor disposed in said pumping chamber, said rotor cooperating with said bore to form two separate working areas, and pressure plate means for at least partially defining a pair of inlet ports through which fluid flows into said working areas during rotation of said rotor in said pumping chamber and a pair of outlet ports through which fluid flows from said working areas during rotation of said rotor in said pumping chamber, said pressure plate means including a plurality of plate sections having major and minor side surfaces and which cooperate to at least partially define said pairs of inlet and outlet ports, said plurality of plate sections includes a first plate section having an outer major side surface disposed in abutting engagement with said body member, a second plate section having inner and outer major side surfaces extending parallel to the outer major side surface of said first plate section, and an intermediate plate section disposed between said first and second plate sections, said intermediate plate section including surface means cooperating with an inner major side surface of at least one of said first and second plate sections to form a passage disposed between said first and second plate sections and interconnecting the ports of one of said pairs of ports, first joining means for fixedly joining a first major side surface of said intermediate plate section to an inner major side surface of said first plate section to prevent leakage of fluid between said first major side surface of said intermediate plate section and said inner major side surface of said first plate section, and second joining means fixedly joining a second major side surface of said intermediate plate section to said inner major side surface of said second plate section to prevent leakage of fluid between said second major side surface of said intermediate plate section and said inner side surface of said second plate section.

3. A pump assembly as set forth in claim 2 wherein said passage is at least partially defined by a pair of parallel surface areas disposed on two of said plate sections and extending between said ports of said one pair of ports, said parallel surface areas being free of openings between said one pair of ports to enable fluid flow through said passage to be only conducted from one port of said one pair of ports to the other port of said one pair of ports.

4. A pump assembly as set forth in claim 2 wherein said passage extends between said pair of inlet ports, said intermediate plate section including means for blocking fluid flow from said passage to said outlet ports.

5. A pump assembly as set forth in claim 2 wherein said first plate section is disposed adjacent to said rotor and is made of a material which has a substantially greater resistance to wear than the other plate sections.

6. A pump assembly as set forth in claim 2 wherein said passage is at least partially defined by a pair of parallel surface areas, one of said pair of parallel surface areas being disposed on said first plate section and the other of said pair of parallel surface areas being disposed on said intermediate plate section, said pair of parallel surface areas extending between said ports of said one pair of ports.

7. A pump assembly comprising a body member having a bore which at least partially defines a pumping chamber, a rotatable rotor disposed in said pumping chamber, said rotor cooperating with said bore to form two separate working areas, and pressure plate means for at least partially defining a pair of inlet ports through which fluid flows into said working areas during rotation of said rotor in said pumping chamber and a pair of outlet ports through which fluid flows from said working areas during rotation of said rotor in said pumping chamber, said pressure plate means including a plurality of plate sections having major and minor side surfaces and which cooperate to at least partially define said pairs of inlet and outlet ports, said plurality of plate sections includes a first plate section having an outer major side surface disposed in abutting engagement with said body member, a second plate section having inner and outer major side surfaces extending parallel to the outer major side surface of said first plate section, and an intermediate plate section disposed between said first and second plate sections, said intermediate plate section cooperating with one of said first and second plate sections to form a passage disposed between said intermediate plate section and said one of said first and second plate sections and interconnecting the ports of one of said pairs of ports, said passage being at least partially defined by a pair of parallel surface areas disposed on said one of said first and second plate sections and on said intermediate plate section, said pair of parallel surface areas extending parallel to said outer major side surface of said first plate section and extending between said ports of said one pair of ports, said passage enabling fluid to be conducted from one port of said one pair of ports to the other port of said one pair of ports along a path disposed between said intermediate plate section and said one of said first and second plate sections.

8. A pump assembly as set forth in claim 7 wherein said first plate section is formed of a metal having a relatively high resistance to wear, said intermediate plate section having a greater ductility and lower resistance to wear than the metal of said first plate section.

9. A pump assembly as set forth in claim 7 wherein said intermediate plate section has a first thickness on opposite sides of said passage and a second thickness which is less than said first thickness in the area where the one of said parallel surface areas disposed on said intermediate plate section is located.

10. A pump assembly as set forth in claim 7 wherein said pair of parallel surface areas are free of openings between said one pair of ports to enable fluid flow through said passage to be only conducted from one port of said one pair of ports to the other port of said one pair of ports.

11. A pump assembly as set forth in claim 7 wherein said intermediate plate section includes a pair of side surfaces which extend transversely to said pair of parallel surface areas to further define said passage.

12. A pump assembly as set forth in claim 7 wherein said first plate section is formed of a metal having a relatively high resistance to wear, said second plate section having a greater ductility and lower resistance to wear than the metal of said first plate section.

13. A hydraulic device comprising a body member which at least partially defines a working chamber, a rotor disposed in said working chamber, and plate means for at least partially defining a first pair of ports through which fluid flows to said working chamber and a second pair of ports through which fluid flows from said working chamber, said plate means including a plurality of plate sections having major and minor side surfaces and which cooperate to at least partially define said first and second pairs of ports, said plurality of plate sections includes a first plate section having an outer major side surface disposed in engagement with said body member, a second plate section having inner and outer major side surfaces extending parallel to the outer major side surface of said first plate section, and an intermediate plate section disposed between said first and second plate sections, said intermediate plate section including surface means cooperating with an inner major side surface of at least one of said first and second plate sections to form a passage disposed between said first and second plate sections and interconnecting the ports of said first pair of ports, said passage being at leat partially defined by a pair of spaced apart surface areas extending parallel to the outer major side surface of said first plate section and disposed on two of said plate sections, said intermediate plate section including a pair of side surfaces which extend transversely to the outer major side surface of said first plate section and cooperate with said pair of spaced apart areas to further define said passage, first joining means for fixedly joining a first major side surface of said intermediate plate section to an inner major side surface of said first plate section to prevent leakage of fluid between said first major side surface of said intermediate plate section and said inner major side surface of said first plate section, and second joining means fixedly joining a second major side surface of said intermediate plate section to said inner major side surface of said second plate section to prevent leakage of fluid between said second major side surface of said intermediate plate section and said inner side surface of said second plate section.

14. A hydraulic device as set forth in claim 13 wherein said plate means has a generally circular configuration and at least one port of said first pair of ports opens radially outwardly to enable fluid to flow into said one port along a path extending generally parallel to the outer major side surface of said first plate section.

* * * * *

UNITED STATES PATENT AND TRADEMARK OFFICE

CERTIFICATE OF CORRECTION

PATENT NO. : 4,072,450
DATED : February 7, 1978
INVENTOR(S) : Robert E. Carlson

It is certified that error appears in the above-identified patent and that said Letters Patent are hereby corrected as shown below:

Column 10, line 6, after "apart" add --surface--.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*